United States Patent [19]

Bain, Jr.

[11] 4,349,240

[45] Sep. 14, 1982

[54] APPLIANCE STRAIN RELIEF

[75] Inventor: Benjamin H. Bain, Jr., Monroe, Conn.

[73] Assignee: General Electric Company, New York, N.Y.

[21] Appl. No.: 205,726

[22] Filed: Nov. 10, 1980

[51] Int. Cl.[3] ..... H01R 13/585

[52] U.S. Cl. ..... 339/103 R; 38/90

[58] Field of Search ..... 38/90–92; 174/166 R, 191, 198; 339/103–107

[56] References Cited

U.S. PATENT DOCUMENTS

| | | | |
|---|---|---|---|
| 1,601,255 | 9/1926 | Marra | 339/103 R |
| 3,665,374 | 5/1972 | Denton | 339/107 X |
| 3,951,504 | 4/1976 | Clark | 339/103 R |
| 4,101,729 | 7/1978 | Balchunas | 339/107 X |
| 4,178,057 | 12/1979 | McCormick | 339/103 M |

*Primary Examiner*—Eugene F. Desmond

*Attorney, Agent, or Firm*—John F. Cullen; George R. Powers; Leonard J. Platt

[57] ABSTRACT

In a portable electric appliance that is cord connected to internal electric terminals by multiple conductors as in an iron, an improved strain relief between the cord and appliance comprises a housing chamber at the cord entrance with a cover over the chamber enclosing the conductors. A formed pocket in the chamber has a straight rear wall and a non-parallel sloped wall both molded as part of the housing and spaced from the rear wall, the two walls angling toward the cord entrance. A boss in the pocket is formed on the rear wall extending toward the sloped wall to define a pair of spaced conductor channels and also a central anchor to secure the cover. A separate barbed wedge-shaped member with barbs directed away from the cord entrance fits between the pocket walls to straddle the boss and slide in the channels. An elongated aperture provides for adjustable and aligning securement to the boss of the wedge between the cover and rear wall whereby the barbs clamp the conductors in the channels, regardless of their size, against any pull force on the cord such that the wedging action is continuously increased for strain relief between the cord and terminal by a simple three-piece construction.

7 Claims, 4 Drawing Figures

APPLIANCE STRAIN RELIEF

BACKGROUND OF THE INVENTION

1. Field of the Invention

This invention relates to a strain relief for an electric appliance, the strain relief being a three-part molded plastic assembly accommodating any size conductors and in which various parts perform multiple functions.

2. Description of the Prior Art

Many portable cord connected electric appliances have stringent safety requirements. Generally, the requirements are such that the appliance should be supportable by the cord alone without putting undue strain on the internal electrical connections for the conductors within the cord. It is undesirable to transmit stress through the cord to the appliance terminals for obvious reasons and it is common to provide various forms of strain relef such as knots, wedges, clamps, or various plates to permit slack in the conductors in the appliance to thus relieve stress on the terminals. Also, to qualify for Underwriters' Labs Inc. approval other parameters must be met. Similarly, there are various foreign equivalents to U.L. that have their own requirements in order for the appliance to be acceptable. While cords and requirements vary, depending on the appliance, a typical appliance to subject the cord to stringent conditions is the electric flatiron and it is to this that the invention is directed for purposes of description although it is by no means so limited. A late development of cord used on appliances is heater parallel neoprene or HPN heater cord which involves chlorosulphonated polyethylene which has a very tough coating and is temperature resistant. Such a cord connecting structure is fully described in U.S. Pat. No. 3,665,374 of common assignment directed to means to prevent breaking of the fine wires within the conductors. In a flatiron, it is customary to provide a point where the cord is tightly compressed between two parts, generally in the iron handle or rear housing. Usually the conductors are attached to the internal terminals and laid against the handle and held by a coverplate with a sharp-edged tongue that presses or "bites" into the cord as the cover is tightened into the handle housing. This squeezing of the cord between the parts relieves the terminals of stress applied by the cord as shown at tongue 22 in said '374 Patent. Other forms of stress relief use clamps 39 as in U.S. Pat. No. 2,727,322 or a strain relief plate 74 in U.S. Pat. No. 2,602,248 both of common assignment. These are all extra parts individually manufactured that require manual labor to apply and so are more costly. An improved and simplified three-part molded plastic construction is desired that is useable with all cords and still meets the U.L. requirements.

SUMMARY OF THE INVENTION

Briefly described, the invention is directed to a strain relief in a portable electric appliance as connected to the internal electric terminal by multiple conductors. The improved assembly comprises a housing chamber in the appliance at the cord entrance with a cover over the chamber enclosing the conductors. A formed pocket in the chamber has a straight rear wall as part of the housing and a non-parallel sloped wall also as part of the housing and spaced from the rear wall with the two walls sloping towards the cord entrance. A boss in the pocket is formed on the rear wall extending towards the sloped wall to define a pair of spaced conductor channels and also form a central anchor to secure the cover. A separate barbed wedge-shaped member fits between the pocket walls straddling the boss and slideable in the channels, the wedge having an apertured ear over the boss formed to adjustably and alignably secure the wedge to the boss between the cover and rear wall. The arrangement permits the barbs on the wedge to clamp any size conductors in the channels with a tightening force by the wedge member against a pull force on the cord whereby a simple three-piece assembly provides strain relief between the cord and terminals. Thus, the main object is to provide an improved three-piece strain relief connection between the cord and electric appliance that meets all U.S. requirements and performs many functions with fewer parts.

DESCRIPTION OF THE PREFERRED EMBODIMENT

The invention is applicable to many cord-connected appliances regardless of the material used but is specifically applicable to an electric flatiron and, for convenience, is described in connection therewith. Also, it is applicable to plural conductor cords including those with a grounding conductor or the more common dual conductor cord and is described in connection with the latter.

Figure 1:
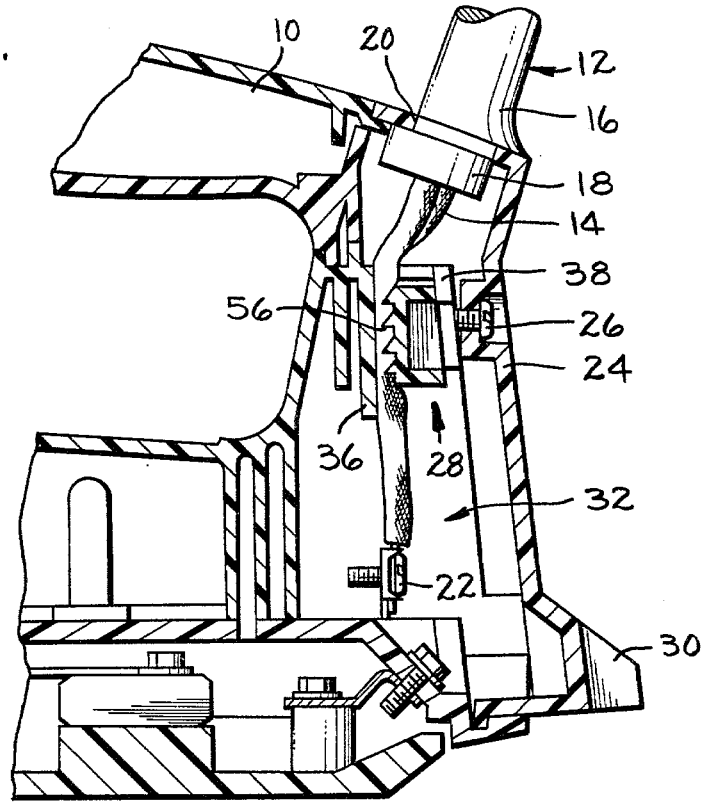
FIG. 1 is a partial sectional view on line 1—1 of FIG. 3 of the rear portion of an iron employing the invention.

Referring to FIG. 1, there is shown an electric flatiron handle 10 from which the usual plural conductor cord 12 extends generally vertically from the back of the handle. The conductors 14 are enclosed and protected by elongated flexible sleeve bushing 16 surrounding the cord and anchored to the handle by an enlarged end 18 inside the handle straddling and locking the bushing inside a handle exit slot 20 in the top of the handle in a well known manner. The cord extends out of the top of the handle at the rear for convenient use without dragging the fabric by either a right or a left-handed operator. After entering the handle, the cord has a portion generally separated into plural conductors 14 connected to internal electrical terminals 22 to supply power to the iron. In the newer irons, substantially all except the soleplate, may be a suitable molded plastic for lightness and coolness. The entire back of the iron is enclosed by a rear cover 24 suitably hooked in place and held by a single bolt 26 for a single securement. To reduce strain on terminals 22 a suitable strain relief 28 engages conductors 14 as is customary. For support in the heel rest position, a formed stabilizer 30 of the outrigger type generally shown in U.S. Pat. No. 3,593,442 of common assignment is molded as part of rear cover 24 so the iron rests in a multiple, essentially a three-point support, when in the vertical heel rest position on a horizontal surface as is well known.

A typical requirement in flatirons is that the strain relief must prevent a stress on the cord from being transmitted to the terminals when either a force (20 lbs.) is applied for one minute, or a two foot drop with cord catch is applied. Additionally, there are demanding supplementary insulation requirements related to temperature. Further, an attached flexible cord must not be able to be pushed into the enclosure of an appliance through the cord entry hole in a manner which will cause a ground or short circuit. Then there is the requirement that molded parts, such as plastic, have to be constructed to have adequate mechanical strength and rigidity to withstand the stresses of actual service. These all put limits on the types of strain relief that may be used and the present invention is designed to meet all these requirements in a simple molded three-piece structure by a unique configuration and arrangement of parts.

Figure 2:
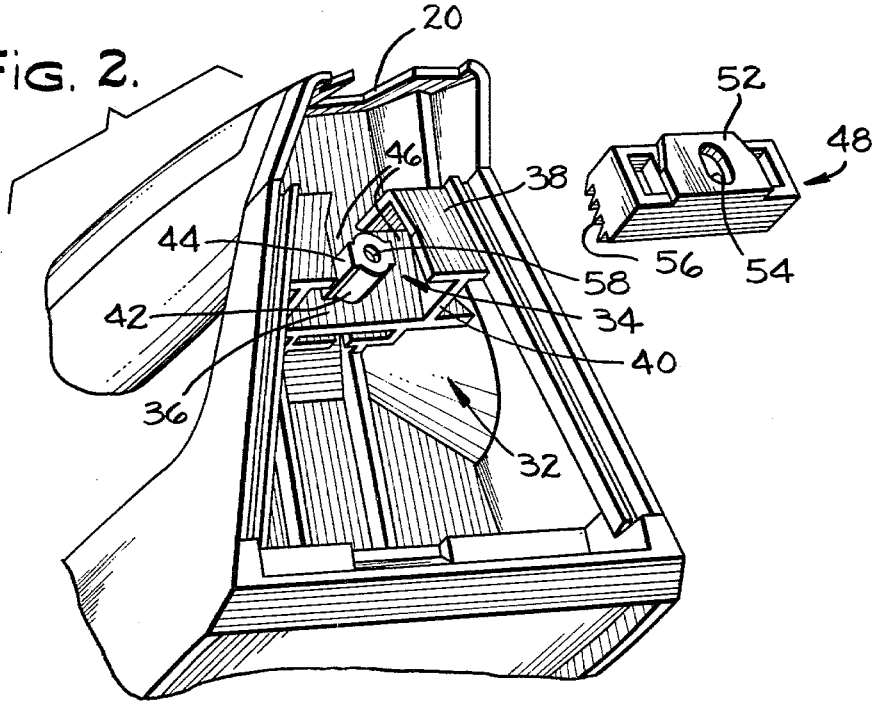
FIG. 2 is an exploded perspective showing the housing chamber and wedge strain relief member.
Figure 3:
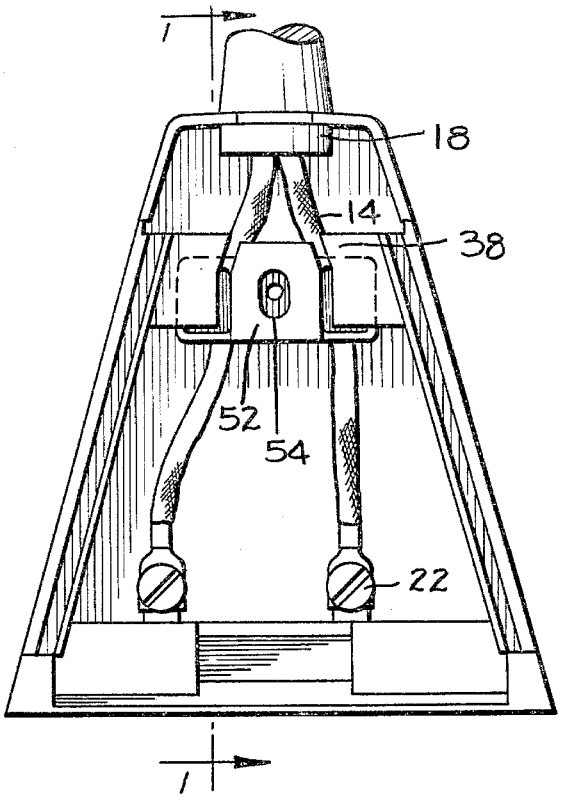
FIG. 3 is a rear elevational sectional view showing the parts assembled.
Figure 4:
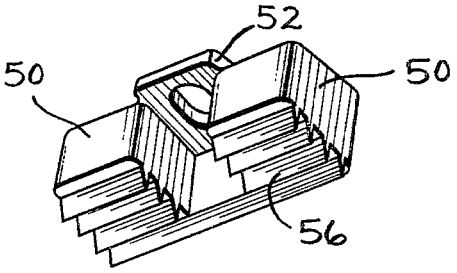
FIG. 4 is a perspective view of the wedge member.

In accordance with the invention, and as seen in FIG. 2, in order to contain the separated conductors 14 there is provided a housing chamber 32 in the appliance substantially at and below the cord entrance and slot 20. The internal conductors, terminals, and chamber are all enclosed by cover 24 which is secured by a single bolt 26 as previously explained. For confining the conductors for strain relief, a formed pocket 34 is provided in the chamber 32 with the pocket having a straight rear wall 36 molded and formed as part of the housing. A second non-parallel sloped wall 38 is formed as part of the housing and is spaced from the rear wall 36 as seen in FIG. 2. The walls and supporting ribs 40 may be a single extruded plastic requiring no separate parts. As seen in FIG. 1, the sloped wall 38 and straight wall 36 are angled together toward the cord entrance at 20 providing a wedging action in that direction. To separate the conductors 14 and provide a central anchor for securement, an extending boss 42 is molded directly as part of the housing on the back wall 36 and has oppositely disposed guiding surfaces or flats 44 thereon with the boss extending towards the sloped wall 38. The boss thus defines a pair of spaced conductor channels 46 on each side thereof. The boss 42 may be centrally located as shown or slightly offset if a three-conductor cable is used. In either case it provides a central anchor and a cord separator as part of the strain relief assembly. For strain relief, a separate barbed wedge-shaped member 48 is formed as shown in FIG. 4 with a pair of side wedge portions 50, which may be hollow, and are designed to fit between the pocket walls straddling the boss 42 for riding or sliding in channels 46. The wedge portions are connected by a formed aperture ear 52 having an elongated or oval shaped aperture 54 directly over the boss 42 for a simple and single securement to the boss by bolt 26 through cover 24. Wedge member 48 is provided on its inner surface with barbs 56 which are downwardly directed or directed away from the cord entrance at 20 and this direction of the barbs resists or tightens against a pull force on the cord tending to pull the cord out of the iron. This resistance occurs by the wedging action as wedge 48 is pulled into the tightening direction or up into the angle between walls 36 and 38.

To accommodate different sized conductors or plural conductors, the elongated aperture 54 thus aligns itself with screw hole 58 in the boss regardless of the conductor size used.

This simple three-part construction of strain relief accommodates different size conductors and continually tightens against a pull force on the cord to pull the cord out of the iron. Further, it is possible to see if the cord is properly clamped and if the proper amount of slack occurs between the clamp or wedge 48 and the cord termination before the back cover 24 is installed. Thus, visual inspection of the cord clamping and cord slack to terminals 22 is available before installing the rear cover 24. The arrangement also provides an improved tighter clamping strain relief which may be tested before the rear cover 24 is installed because of the simplified assembly. Finally, the clamping force or strain relief on the terminals improves with use since the wedging action tightens as the cord is pulled out because the harder the pull the tighter the clamp or wedge engages the conductors to remove all strain on the terminals.

While I hereinbefore described a preferred form of the invention, obvious equivalent variations are possible in light of the above teaching. It is therefore to be understood that, within the scope of the appended claims, the invention may be practiced otherwise than as specifically described, and the claims are intended to cover such equivalent variations.

I claim:

1. In a portable electric appliance cord connected to internal electric terminals by multiple conductors, an improved strain relief assembly between the cord and appliance comprising, a housing chamber in the appliance at the cord entrance, a cover over said chamber enclosing the conductors, a formed pocket in said chamber having a straight rear wall as part of said housing, a non-parallel sloped wall as part of said housing spaced from the rear wall, a boss in said pocket formed on the rear wall extending toward the sloped wall defining a pair of spaced conductor channels and an anchor to secure said cover, a separate barbed wedge-shaped member fitting between said pocket walls straddling the boss and slidable in said channels, means adjustably securing and aligning said wedge between the cover and rear wall to said boss whereby the barps clamp the conductors in the channels with a tightening force by said wedge member between the walls providing strain relief between the cord and terminals.

2. Apparatus as described in claim 1 wherein said boss is disposed centrally of the pocket.

3. Apparatus as described in claim 1 wherein said spaced walls angle together toward the cord entrance to said appliance.

4. Apparatus as described in claim 3 wherein said boss is disposed centrally of the pocket and said wedge member has an apertured ear over the boss for single securement through the cover to the boss.

5. Apparatus as described in claim 4 wherein the barbs on said wedge member are directed away from the cord entrance.

6. Apparatus as described in claim 5 wherein the aperture in said ear is elongated to align the wedge for securement in said pocket for different size conductors.

7. Apparatus as described in claim 6 wherein said appliance, cover, and wedge are all molded plastic to comprise a three-part construction which accommodates different size conductors and continually tightens against a pull force on said cord to strain relief said terminals.

* * * * *